US007112178B1

(12) United States Patent
Roozenburg

(10) Patent No.: US 7,112,178 B1
(45) Date of Patent: Sep. 26, 2006

(54) COLD THERAPY FOOT MASSAGER

(76) Inventor: Nancy Jean Roozenburg, 1006 E. Sugnet Rd., Midland, MI (US) 48642

( * ) Notice: Subject to any disclaimer, the term of this patent is extended or adjusted under 35 U.S.C. 154(b) by 0 days.

(21) Appl. No.: 10/915,062

(22) Filed: Aug. 10, 2004

Related U.S. Application Data

(60) Provisional application No. 60/495,976, filed on Aug. 18, 2003.

(51) Int. Cl.
*A61H 1/00* (2006.01)

(52) U.S. Cl. ..... 601/15; 601/19; 601/121

(58) Field of Classification Search ..... 601/15, 601/18, 19, 22, 84, 121, 134; 482/104–108, 482/33, 49, 50, 131, 132; 606/237, 240
See application file for complete search history.

(56) References Cited

U.S. PATENT DOCUMENTS

| | | | | |
|---|---|---|---|---|
| 3,035,570 | A | 5/1962 | Nelson | |
| 3,842,453 | A * | 10/1974 | Refield | 5/643 |
| 4,014,325 | A | 3/1977 | Clarke | 601/121 |
| 4,109,649 | A | 8/1978 | Iyomasa | 601/121 |
| D253,373 | S | 11/1979 | Celeste | |
| 4,378,007 | A * | 3/1983 | Kachadourian | 601/121 |
| 4,380,231 | A | 4/1983 | Rocha et al. | 601/118 |
| 4,538,806 | A * | 9/1985 | Wilkerson | 482/108 |
| 4,627,618 | A * | 12/1986 | Schwartz | 482/108 |
| 4,720,098 | A * | 1/1988 | Gordon | 482/108 |
| 4,910,978 | A | 3/1990 | Gordon et al. | 62/530 |
| 5,056,778 | A * | 10/1991 | Hull et al. | 482/105 |
| 5,131,383 | A | 7/1992 | Juarez | 601/19 |
| 5,251,620 | A | 10/1993 | Boucher et al. | 601/122 |
| 5,411,470 | A | 5/1995 | Liptak et al. | 601/118 |
| 5,558,625 | A | 9/1996 | McKay | 601/118 |
| 5,830,161 | A | 11/1998 | Cosmano | 601/121 |
| 6,129,687 | A * | 10/2000 | Powell et al. | 601/15 |
| 6,258,048 | B1 | 7/2001 | Montague | 601/19 |
| 6,499,485 | B1 * | 12/2002 | Pepera | 128/845 |
| 6,793,636 | B1 * | 9/2004 | Pepera | 601/15 |
| 2003/0181836 | A1 | 9/2003 | Cameron | |
| 2005/0085749 | A1 * | 4/2005 | Baerwalde et al. | 601/15 |

* cited by examiner

*Primary Examiner*—Michael A. Brown

(57) ABSTRACT

A manual cold therapy foot massage device, which consists of a long cylindrical rod that is hollow in nature. Two rollers connected to each end of the cylindrical rod are wider in diameter than the cylindrical rod allowing the device to roll back and forth easily over a flat surface while being used. The cylindrical rod is filled with a non-freezable gel and wrapped with a flexible reusable cold compress that is also gel filled. The device can be placed in the freezer to reduce the gel filled cylinder and cold compress to freezing temperatures and removed for treatment to provide an ice therapy massage for the bottom of the foot or other affected areas.

1 Claim, 4 Drawing Sheets

COLD THERAPY FOOT MASSAGER

CROSS-REFERENCE TO RELATED APPLICATIONS

Figure 1:
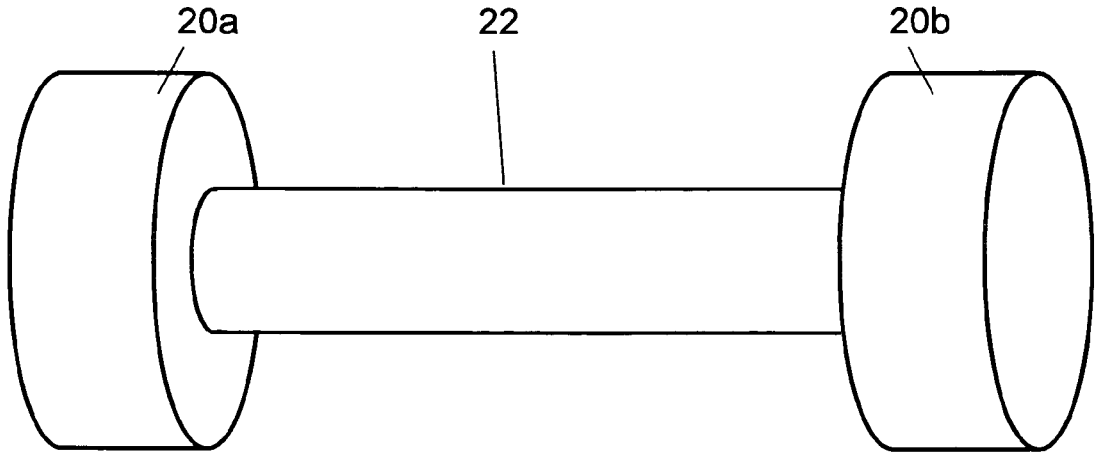

This application claims the benefits of PPA Application No. 60/495,976 filed Aug. 18, 2003 for Heat/ice Therapy Foot Massager

FEDERALLY SPONSERED RESEARCH

N/A

SEQUENCE LISTING OR PROGRAM

N/A

FIELD OF INVENTION

The present invention relates to a physical therapy device used for treating injuries to the foot or other affected area by means of cold therapy and massage.

DESCRIPTION OF PRIOR ART

This device was developed to provide a safe, durable, and efficient method for applying cold therapy to foot related injuries, most specifically plantar fasciitis. Plantar fasciitis is a debilitating injury to the tendon or fascia that runs the length from the ball of the foot to the heel. Occasionally, this tendon will become inflamed through improper stretching or equipment, over-use injuries, or during everyday exercise such as walking. The heel of the foot is the most tender in the morning and feels as if there is a bruise. The pain eventually subsides as the tendon is stretched through walking but can recur during periods of rest. If left untreated, it can become worse to the point where surgery needs to be performed. Rest, ice therapy, and gentle stretching are the three most commonly used methods for treating Plantar Fasciitis.

Suffering from this injury myself, I originally used a recommended method of treatment which calls for placing a water-filled plastic bottle in the freezer to solidify the contents. The bottle is removed from the freezer when the contents are solid and is placed on its side on the floor or other flat area. The foot is then placed on the bottle and rolled back and forth over the bottle to provide a cold therapy massage. While it worked initially, within minutes the plastic bottle ruptured from the pressure of rolling my foot back and forth and also left a wet area on the carpet where it was being used. This method cannot be used on a hard floor surface because the bottle would slide. Also, a towel cannot be placed on the carpet for protection because it becomes entangled as the bottle is rolled over it. In addition, the ice does not melt evenly and eventually the ice will slide back and forth within the bottle and will no longer roll. While the crude method above is currently being recommended as an option for treating the pain, inflammation, and swelling resulting from a foot injury, it also not recommended for all individuals. Ice should not be used by patients who may have medical problems such as circulatory issues or rheumatoid arthritis that may be further injured due to the cold temperatures of the ice. The ice itself can also cause further injury as the surface is hard and can cause bruising or increased soreness in the bottom of the foot or may overstretch the tendon because of its lack of flexibility.

Other methods for treating foot related injuries include cold compresses which are wrapped around the injured area and held in place by a towel or compression wraps where cold compresses are inserted into individual pockets within the compression wrap to apply cold therapy to the injured area. Such inventions are taught in U.S. Pat. No. 4,910,978 to Gordon and U.S. Pat. No. 4,592,358 to Westplate. These inventions also either contain a refrigeratable gel enclosed in an envelope like structure or provide a pocket or compartment to insert cold compresses that contain a refrigeratable gel. While the above devices can be effective in providing cold therapy, they do not also provide a therapeutic massage to the tendon that runs the length of the bottom of the foot. It is recommended that the tendon be stretched gently to help ease the lack of flexibility in the foot. So therefore the above method of treating with a cold compress does not also provide active therapy which is considered to be more beneficial.

Presently, I am not aware of any current products or prior art that are improvements over the ice filled water bottle. There have, however, been massage therapy products introduced over the years such as that taught in U.S. Pat. No. 5,411,470 to Spector that demonstrates the same ability to massage the bottom of the foot by providing a massager that can roll easily over a flat surface as the foot is being moved in a back and forth motion. There have also been foot massage products that don't require any movement on the part of the patient where the foot is simply placed on the massager and the rollers move electronically or by some other means to massage the bottom of the foot while the patient remains in a seated position.

All of the above massagers have limitations in that they have a hard, non-flexible surface and therefore have the potential to create bruising or further swelling of the foot and also do not provide a means for applying a soft gentle massage to the bottom of the foot in a way that will not cause further harm to the patient.

The prior art does not demonstrate a massage therapy device for the foot that can simultaneously provide cold therapy while also providing a therapeutic gentle massage to the user where the surface of the device is soft and will not further injure the patient. Therefore, there remains a need for a simple, convenient, easy-to-use cold therapy foot massager which is capable of treating the pain, inflammation, and swelling of a foot injury such as plantar fasciitis which also provides a gentle massage to the bottom of the foot without causing further injury.

OBJECTS AND ADVANTAGES

Several objects and advantages of the Cold Therapy Foot Massager device are that it provides a method for cold therapy which cools the injured area, preventing inflammation and swelling while simultaneously providing a gentle massage to the bottom of the foot as the foot rolls back and forth over the device on a flat surface. Further objects and advantages are that it also provides a soft surface for the foot to roll over as the cylinder of the device is covered in a reusable cold compress that is filled with a gel material that remains flexible to temperatures below 32 F. The compress is wrapped around the cylinder of the device and secured so that is does not move while being used and is also held in place by a thin sleeve that is pulled over the compress. Both the compress and sleeve are made from a moisture wicking fabric that will keep condensation from accumulating as the device is being used. The device is stored conveniently in the freezer when not in use and can be removed easily to begin therapy immediately. The temperature of the gel filled compress is maintained for an extended period by the gel that is contained in the hollow cylinder of the device and helps to keep the compress cold during the entire treatment period. In addition, the device is designed with the rollers being greater in diameter than the compress wrapped cylinder of the device so that the compress doesn't touch the surface of the floor. The rollers can be texturized around the outer circumference which comes into contact with the surface of the floor to prevent the device from slipping when used on a soft surface such as carpeting. The texture is only mildly abrasive and actually feels soft to the touch so that it does not cause damage when used on a hard flat surface such as linoleum or wood flooring.

SUMMARY OF THE INVENTION

The primary objective of the invention was to develop a durable, easy to use device that overcame the shortcomings of prior art by providing the means of applying the recommended cold therapy to foot injuries in addition to providing a soft surface for a gentle massage for the bottom of the foot so as not to cause further injury. This was accomplished by designing the device to resemble a small dumbbell with end rollers that are wider in diameter than the gel pack covered cylinder, allowing the device to roll easily over a flat surface. The material for the roller device was chosen for its durability and toughness so the cylinder could be hollow and still retain its strength, allowing it to be filled with the non-freezable gel. In addition, if the device were accidentally dropped, it would not shatter.

The cylindrical rod filled with a non-freezable gel is then covered with a soft, flexible, gel-filled ice pack to soften the treatment for an injury without causing further harm. The gel pack was designed from a plastic laminated fabric which has an external bladder of a moisture wicking fabric. The internal layer of plastic is laminated to the fabric which in combination provides a cold compress that is flexible but durable enough to be used repeatedly. The reusable cold compress is then held into place with a soft, polyester fabric sleeve that has elastic at each end to allow it to be pulled easily over the roller massager and still remain taught so that it doesn't slide when being used. In addition, the fabric sleeve is made of a soft, moisture wicking fabric that prevents condensation from accumulating during use.

The rollers attached to the cylindrical rod are the portion of the device that comes into contact with the surface where the treatment is being delivered. In order to prevent the device from sliding when being used on a carpeted surface, the rollers were texturized around the outer circumference. However, the depth of the texture is immaterial when being used on a flat surface such as linoleum or wood and will not cause damage.

BRIEF DESCRIPTION OF THE DRAWING FIGURES

Figure 2:
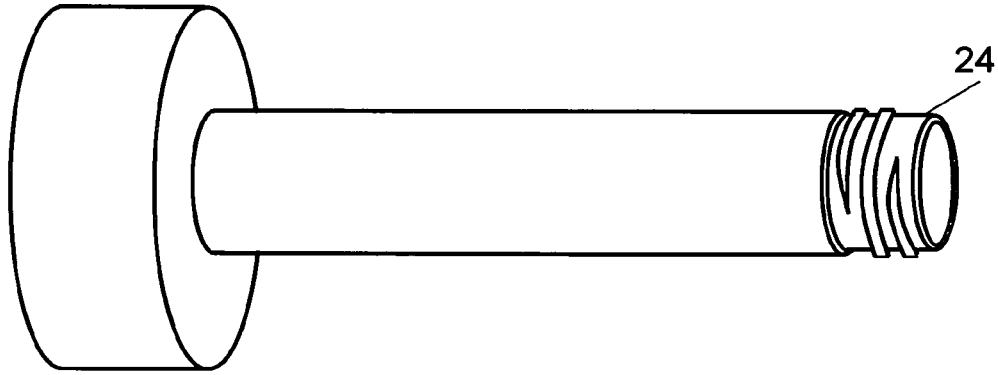
Figure 3:
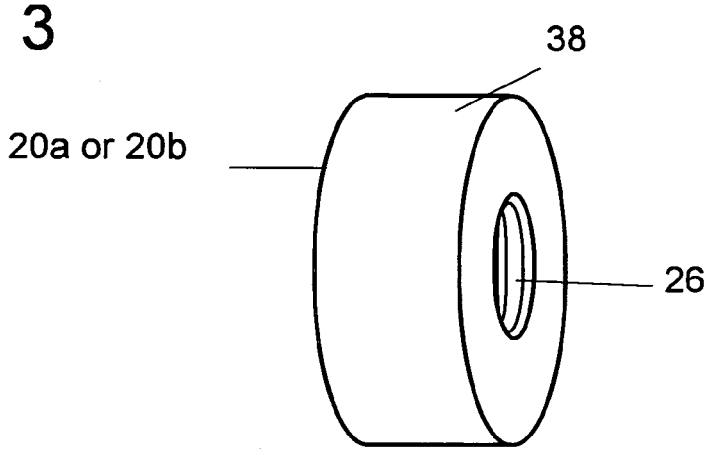
Figure 4:
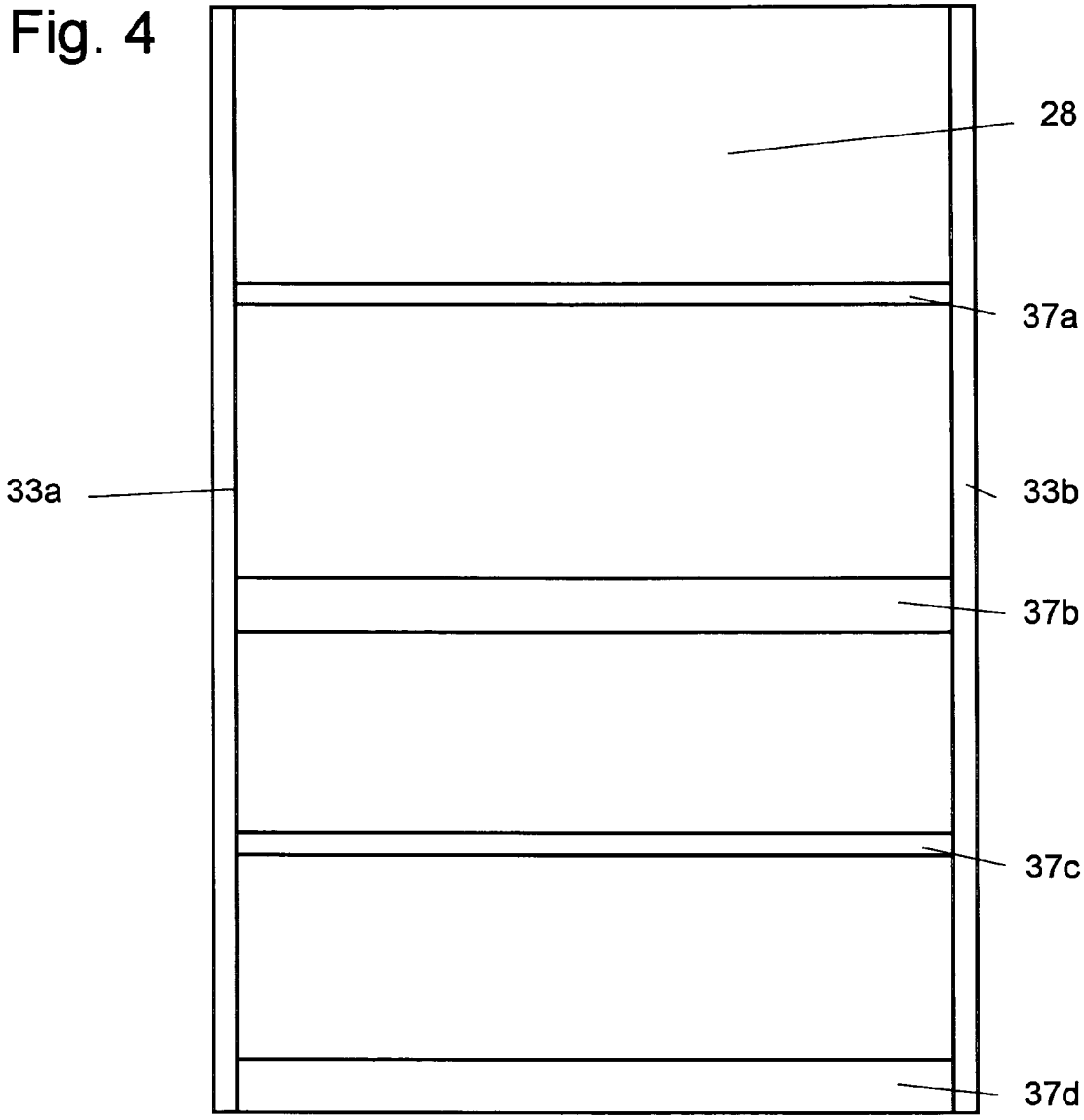
Figure 5:
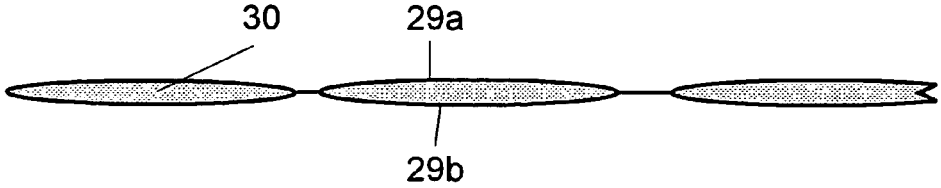
Figure 6:
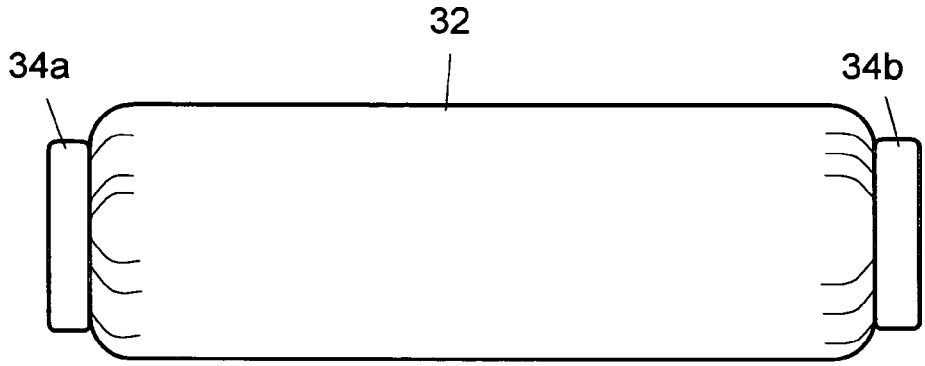
Figure 7:
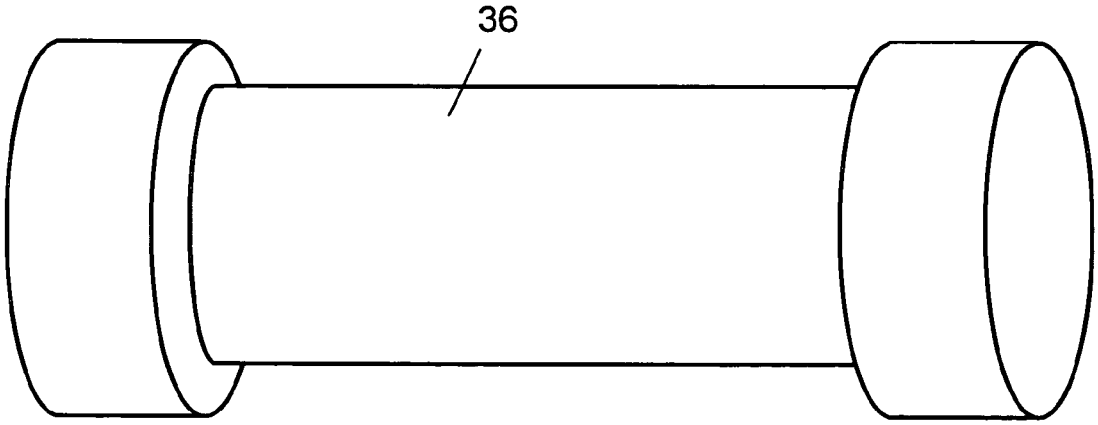
Figure 8:
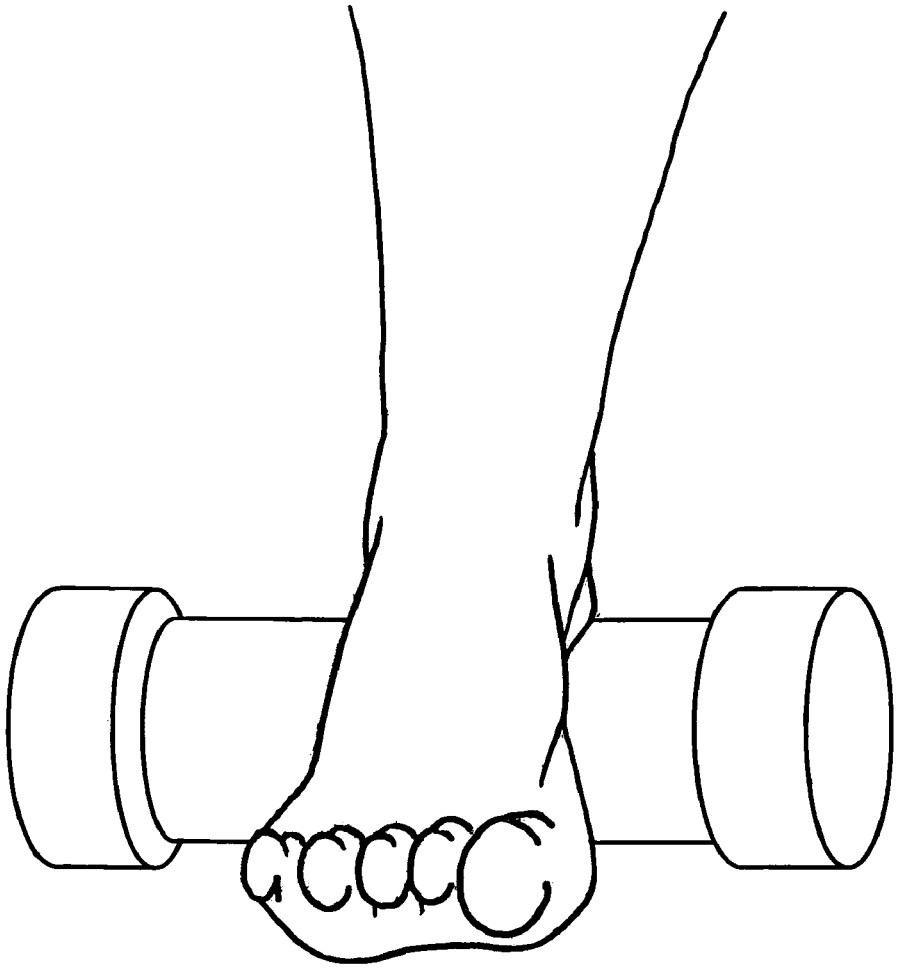

FIG. 1 is a front perspective view of the preferred Cold Therapy Foot Massager device of the present invention:

FIG. 2 is a front perspective view of the preferred Cold Therapy Foot Massager device of the present invention with one roller removed FIG. 3 is a side perspective view of one of the rollers detached from the device, showing the threaded opening FIG. 4 is a front view of the reusable cold compress of the present invention FIG. 5 is a cross-sectional view of the cold compress of the present invention FIG. 6 is a front view of the fabric sleeve of the present invention FIG. 7 is a front perspective view of the cold therapy foot massager wrapped with the reusable cold compress and covered with the fabric sleeve FIG. 8 is a front perspective view of the preferred cold therapy foot massager of the present invention used to treat a foot injury.

DRAWINGS—LIST OF REFERENCE NUMERALS

20*a*—Roller
20*b*—Roller
22—Cylindrical rod
24—Threaded end of cylindrical rod
26—Threaded opening of roller 20*a* or 20*b*
28—Cold compress
29*a*—One of the fabric laminated sides of the cold compress
29*b*—One of the fabric laminated sides of the cold compress
30—Non-freezable gel sealed within the four sections of the cold compress
32—Fabric sleeve
33*a* and *b*—A sealed edge of the cold compress along the longest edge
34*a* and *b*—The elastic ends of the fabric sleeve
36—Cold compress covered cylindrical rod
37*a, b, c*, and *d*—the seals which separate the four sections of the cold compress

DETAILED DESCRIPTION OF THE DRAWING FIGURES

The following drawings represent the above object and are illustrative in nature. Only slight modifications may be made in the specific construction illustrated and described but within the scope of the appended claims.

FIG. 1 shows a perspective view of the cold therapy foot massager before the cold compress from FIG. 4 is wrapped around the cylinder. This diagram demonstrates the cylindrical nature of the rollers, 20*a* and 20*b*. This enables the device to roll easily over a flat surface while being used. It also shows that the two rollers are greater in diameter than the cylindrical rod, 22 that joins them, further enabling the device to roll easily over a flat surface while being used on either a hard or soft surface such as linoleum or carpeting. The larger size of the rollers keeps the cold compress covered cylinder, FIG. 7 from leaving a mark or wet spot on the surface where it is being used.

FIG. 2 is a front perspective view of the device with one of the rollers removed illustrating the hollow, cylindrical nature of the rod and threaded end of the cylindrical rod, 24 will be sealed by screwing the cylindrical rod into the roller illustrated in FIG. 3. The rod, being hollow in nature will preferably be filled with a FDA approved, non-freezable gel, allowing the device to be placed in the freezer without risk of cracking the cylinder. The gel within the cylinder will also assist in maintaining the temperature of the preferred external, gel-filled, reusable cold compress, 28 as it is insulated from the temperature outside of the freezer by the compress. In addition, the ability to remove the rollers from the cylinder allows for the ability to easily slide the fabric sleeve 32 over the cold compress once it is wrapped around the cylinder and will keep manufacturing cost down. The roller is then screwed back onto the end of the cylindrical rod and is sealed in place with a permanent bonding material so that it doesn't become loose while being used. This view and assembly is the same for the opposite side of the device as well.

FIG. 3 is an inside perspective view of the roller illustrating the opening, 26 where the threaded end of the cylindrical rod, 24 attaches to the roller perpendicularly. The threaded opening is directly in the center of the roller to allow the device to roll back and forth evenly over a flat surface while being used. This view is the same for both rollers on the device.

FIG. 4 is a front view of the cold compress, 28 that is wrapped around the cylinder of the Cold Therapy Foot Massager device. The cold compress is made from a plastic laminated fabric where two sides of the prepared fabric, 29*a* and 29*b* have an external fabric layer that is made from a moisture wicking fabric and an internal layer of plastic that comes into contact with the contents. The cold compress is gel filled with a non-freezable food grade gel that is capable of remaining flexible when reduced to temperatures below freezing. The cold compress is sealed around the outer edge by means of a heat treating process with RF heat sealing to be the preferred method in order to form an envelope that will contain the non-freezable gel. The compress is further divided into four separate sections 37*a*, 37*b*, 37*c*, and 37*d* to prevent the gel from sliding to one end of the compress and the foot is pressed down on the device during treatment. The method for separating the sections can be accomplished by heat treating the two plastic laminated fabric layers 29*a* and 29*b* before the compress is filled with gel. One sealed side of the compress, 33*a* or 33*b* will remain open to create a receptacle where the gel is inserted. After the gel has been inserted into each of the four sections, the open side will be sealed to contain the contents. The compress will wrap around the cylindrical rod twice beginning with the end that has the two smaller sections and is then overlapped with the remaining two larger sections which are wider to cover the larger circumference of the cylinder that results from being wrapped with the first two smaller sections.

FIG. 5 shows a cross-section view of the cold compress and the gel filled sections, 30. The gel which remains flexible when frozen provides a soft surface for treatment to the injured area of the foot and in combination with the firm surface of the cylindrical rod is able to provide a gentle pressure for massaging the bottom of the foot without causing further injury.

FIG. 6 is a front or top view of the soft fabric sleeve, 32 that is made from a stretchable, moisture wicking fabric such as polyester and has narrow elastic, 34*a* and 34*b* at each end so that it can be easily pulled over the cold compress wrapped cylinder and secured in place. The fabric sleeve is made from a single layer of fabric so as not to inhibit the cold therapy and is slightly shorter in length and diameter when compared to the cold compress wrapped cylinder. However, the elastic nature of the fabric allows it to be pulled over the compress wrapped cylinder easily and then secure in place as the fabric retains its original size.

FIG. 7 is a front perspective view of the Cold Therapy Foot Massager of the present invention, 36 after the cylinder of the roller device is wrapped with the cold compress and secured in place with the moisture wicking fabric sleeve. The compress covered cylindrical rod remains smaller in diameter than the outside rollers allowing it to move easily back and forth over a flat surface without damaging the floor or carpeting.

FIG. 8 is a front perspective view of the Cold Therapy Foot Massager device as it is intended for use. While the individual is in a seated position, the foot will be placed on top of the device and rolled backward and forward in slow methodical movements beginning with the area of the greatest pain and inflammation and then extending slowing to include the remaining portion of the bottom of the foot. This action not only provides a therapeutic cold treatment but also a gentle massage to the bottom of the foot. In an alternative embodiment, if the device is made in larger sizes, it can be used to treat larger areas of injury that can include the leg or upper body. As an additional alternative, the device in its current size can be used on other areas of the body as well which can include the wrist, arm, or ankle.

It is my intention to design this device from a plastic material such as polyurethane or acrylic due to the durable nature of this material. The rollers are solid with the exception of where the cylindrical rod will screw into the inside center FIG. 3. The cylinder will be hollow and will have an internal diameter which is smaller than the external diameter by approximately 0.125 inches to maintain the durability of the device yet allow for the coldness of the contained gel to permeate to the outside compress.

The cold compress that is wrapped around the cylinder was designed with an external layer of a moisture wicking fabric to prevent the device from sweating or dripping while it is being used. Commercial ice packs used currently are made of a plastic, gel filled bag and have a tendency to sweat when removed from the freezer and brought to room temperature. Polyester is a fabric that is known for its ability to wick moisture away from the skin and maintain a feeling of dryness. The internal bladder of plastic laminated to the polyester creates an impermeable layer for the gel inside the device, keeping it from leaking or rupturing during use. The plastic also has cold crack properties that allow it to be placed in the freezer repeatedly without hardening or cracking over time. Other plastics without this cold crack property have a tendency to harden and crack through repeated exposure to freezing temperatures.

The fabric sleeve is also made from a moisture wicking fabric to maintain the dry surface for use. This sleeve will be pulled over the gel-filled, flexible, reusable cold pack after it is wrapped around cylinder of the device to secure the gel pack and prevent it from slipping.

OPERATION

In preparation for use, the cold therapy foot massager is placed in the freezer for a period of at least two hours to reduce the temperature of the gel material contained in the cylinder and cold compress to at least 32 F or below. Upon suffering an injury that results in pain and swelling, the patient removes the device from the freezer and places in on a flat surface that can include carpeting, wood, linoleum or any other firm flat surface. While in a seated position, the patient will place their foot on top of the device with the cold compress covered cylinder against the arch of the foot and slowly move the foot back and forth. The flexibility of the cold compress covered cylinder and shape of the device allows it to conform neatly to the contours of the patient's foot. The soft exterior made of a moisture wicking fabric prevents the device from sweating or leaking condensation as the device warms to the temperature of the user's skin or the environment outside of the freezer. When the device loses its cold temperature, it can be returned to the freezer and stored for further treatment.

Thus, the present invention provides a fast, convenient, easy-to-use, method for treating foot injuries which has a soft exterior or treatment portion that prevents further injury to the patient and is made from a material that prevents moisture from gathering on the surface of the cylinder area. It also conforms to the variations in shape of each patient due to the ability of the cold compress covered cylinder to maintain flexibility at a reduced temperature of at or below freezing.

CONCLUSION, RAMIFICATIONS, AND SCOPE OF THE INVENTION

Thus the reader will see that the Cold Therapy Foot Massager of the present invention provides an easy-to-use, convenient means of providing cold therapy in conjunction with a foot massage. This device helps to control pain and swelling and speeds healing from injury through cold therapy and also prevents injuries by increasing flexibility as it provides active therapy or a gentle massage to the area of the foot where the injury has occurred. In addition, the surface of the device is wrapped in a soft, flexible cold compress that conforms easily to variations in the surface of the patient's foot and remains flexible when reduced to temperatures below freezing, providing a soft surface for treatment that will not cause further injury to the patient. The exterior fabric of the cold compress as well as the fabric sleeve that is used to secure it in place are made from a moisture wicking material that eliminates the condensation that accumulates with other cold compresses. The rollers of the device are greater in circumference than the cold compress covered cylinder providing an elevated surface for treatment so that the device will roll easily over a flat surface. In addition, the rollers can be texturized around the outer circumference to prevent the device from slipping when used on soft surfaces such as carpeting.

What is claimed is:

1. A method for treating pain and swelling in an injured area of a foot, said method being performed using a device comprising in combination two rollers and a body, said rollers being cylindrical in nature attached perpendicularly to each end of said body, said body, being cylindrical in shape is smaller in diameter than said rollers, said body defining a cavity therein, said cavity containing a gel material, further comprising a cold compress, said cold compress having a soft, flexible surface and a plurality of sections, said sections including two upper sections and two lower sections, said two upper sections being smaller than said two lower sections, said cold compress being divided into said sections to prevent a gel material contained in each section from sliding from one end to the other end of said cold compress, said cold compress is wrapped around the body twice, with the two upper smaller sections being wrapped around the body first and the two larger sections being wrapped around the body afterwards, the method comprising the steps of:

a. storing the device in a freezer in order to reduce the gel material contained in the body cavity and cold compress sections to a temperature at or below freezing;

b. removing the device from the freezer;

c. placing the device on a flat surface and positioning the injured area of the foot on said soft, flexible surface and said upper and lower sections of said cold compress, said soft, flexible surface of said cold compress allowing it to conform to the surface of the injured area of the foot, slowly rolling the device back and forth over the injured area to provide an active therapy to reduce pain and swelling of the injured area through cold therapy while simultaneously providing a gentle massage to the injured area.

* * * * *